United States Patent [19]

McWilliams

[11] 4,447,710

[45] May 8, 1984

[54] ELECTRIC COOKERS INCORPORATING RADIANT HEATERS

[75] Inventor: Joseph A. McWilliams, Hadzor, England

[73] Assignee: Micropore International Limited, Droitwich, England

[21] Appl. No.: 405,719

[22] Filed: Aug. 6, 1982

[30] Foreign Application Priority Data

Aug. 8, 1982 [GB] United Kingdom ..... 8124324

[51] Int. Cl.[3] ..... H05B 3/68

[52] U.S. Cl. ..... 219/449; 219/358; 219/460; 219/464; 219/510

[58] Field of Search ..... 219/358, 441, 449, 459, 219/460, 464, 467, 510, 512, 448, 494, 505, 506; 337/382, 394

[56] References Cited

U.S. PATENT DOCUMENTS

| | | | |
|---|---|---|---|
| 3,612,828 | 10/1971 | Siegla | 219/464 |
| 3,646,321 | 2/1972 | Siegla | 219/464 |
| 3,710,076 | 1/1973 | Frazier | 219/449 |
| 4,347,432 | 8/1982 | Gössler | 219/449 |
| 4,350,875 | 9/1982 | McWilliams | 219/449 |
| 4,388,520 | 1/1983 | McWilliams | 219/464 |

FOREIGN PATENT DOCUMENTS

| | | | |
|---|---|---|---|
| 2071969 | 9/1981 | United Kingdom | 219/449 |

*Primary Examiner*—Volodymyr Y. Mayewsky
*Attorney, Agent, or Firm*—Browdy and Neimark

[57] ABSTRACT

A glass ceramic top cooker has at least one radiant heater arranged beneath the glass ceramic surface, the or each radiant heater comprising a continuous base layer of electrical and thermal insulating material, a peripheral wall also of electrical and thermal insulating material, and a heating element arranged on the base layer. The radiant heater also includes means, such as a pad, disposed on the base layer for isolating a region within the peripheral wall from heat emitted by the heating element and a temperature sensor, such as a thermocouple or a platinum resistance, mounted within the isolated region so as to be sensitive in use substantially only to the temperature of a cooking pan which is heated by the heater. The temperature sensor is effective because there is created on the glass ceramic plate a cold patch through which the temperature of the pan can be determined.

17 Claims, 7 Drawing Figures

ELECTRIC COOKERS INCORPORATING RADIANT HEATERS

BACKGROUND OF THE INVENTION

The present invention relates to electric cookers incorporating radiant heaters and more particularly relates to glass ceramic top cookers, which have one or more radiant heaters arranged beneath the glass ceramic cooking surface.

DESCRIPTION OF PRIOR ART

A radiant heater for a glass ceramic top cooker generally comprises a metal dish containing a base layer and a peripheral wall made of an electrically and thermally insulating material. Arranged on the base layer is a heater element in the form of a bare helically-coiled wire which radiates heat upwardly towards and through the glass ceramic top when the heater is switched on. The heater is protected against overheating by means of a probe-type thermal cut-out device which extends across the heater element.

It is sometimes considered desirable to control the cooking process in a utensil placed on the glass ceramic cooking surface above a particular heater by means of a temperature sensor which senses the temperature of the bottom of the utensil and which controls the energy supplied to the heating element by means of an associated control device. Such a system is often called an "autocook" system. The temperature sensor may comprise a bulb filled with an expansible fluid, which bulb is inserted through a specially formed aperture through the base of the heater and is urged against the underside of the glass ceramic plate. Alternatively, the temperature sensor may be an electro-mechanical device which is inserted through the aperture in the heater and is urged against the underside of the glass ceramic plate. However, with a glass ceramic top cooker there is a problem because it is not possible accurately to sense the temperature of the utensil through the glass ceramic top and, additionally, the radiant heat from the heating element affects the operation of the temperature sensor.

OBJECT OF THE INVENTION

It is an object of the present invention to provide a radiant heater and a glass ceramic top cooker in which the temperature sensor accurately senses the temperature of the cooking utensil through the glass ceramic plate.

SUMMARY OF THE INVENTION

According to one aspect of the present invention there is provided a radiant heater for an electric cooker, which heater comprises:

- a continuous base layer of electrical and thermal insulating material;
- a peripheral wall of electrical and thermal insulating material;
- a heating element arranged on the base layer;
- means disposed on the base layer for isolating a region within the peripheral wall from heat emitted by the heating element; and
- a temperature sensor mounted within the isolated region so as to be sensitive in use substantially only to the temperature of a cooking pan which is heated by the heater.

According to a second aspect of the present invention there is provided a glass ceramic top cooker which includes at least one radiant heater, the heater comprising:

- a continuous base layer of electrical and thermal insulating material;
- a heating element arranged on the base layer;
- means disposed on the base layer for isolating a region within the peripheral wall from heat emitted by the heating element; and
- a temperature sensor mounted within the isolated region so as to be sensitive in use substantially only to the temperature of a cooking pan which is heated by the heater.

Thus, the temperature sensor is effective because there is created on the glass ceramic plate a cold patch through which the temperature of the cooking utensil can be determined.

The isolated region may be formed by a pad of insulating material. The pad may be arranged adjacent to the peripheral wall of the heater. The pad may be circular and may have a diameter of 40–50 mm. Alternatively, the pad may be part-circular at the radially inner region of the heater, but may conform to the curvature of the peripheral wall of the heater where the peripheral wall and the pad are close to one another. The pad may be made of ceramic fibre. Generally, the pad may have an area of approximately 4% to 8% of the area within the peripheral wall of the heater.

The temperature sensor may be a thermocouple and may be made, for example, of chromel/alumel or copper/constantan. The thermocouple wires may have a diameter of 1 mm to 2 mm. The temperature sensor may be mounted in the region of the centre of the isolated region. Alternatively, the temperature sensor may be mounted in the isolated region so as to be offset from the centre thereof towards the centre of the heater.

However, problems can still arise as a result of variations in the shapes and positions of cooking utensils. These problems may be overcome, though, by providing means for determining the location of the base of the utensil relative to the glass ceramic top and by controlling the supply of electric current to a heating element of the radiant heater in response to the apparent temperature of the utensil detected by the temperature sensor and in response to the location of the base of the utensil.

The location determining means may comprise a transducer positioned in the isolated region adjacent to the temperature sensor. The transducer may be a capacitative transducer.

For a better understanding of the present invention and to show more clearly how it may be carried into effect reference will now be made, by way of example, to the accompanying drawings in which:

DESCRIPTION OF PREFERRED EMBODIMENTS

Figure 1:
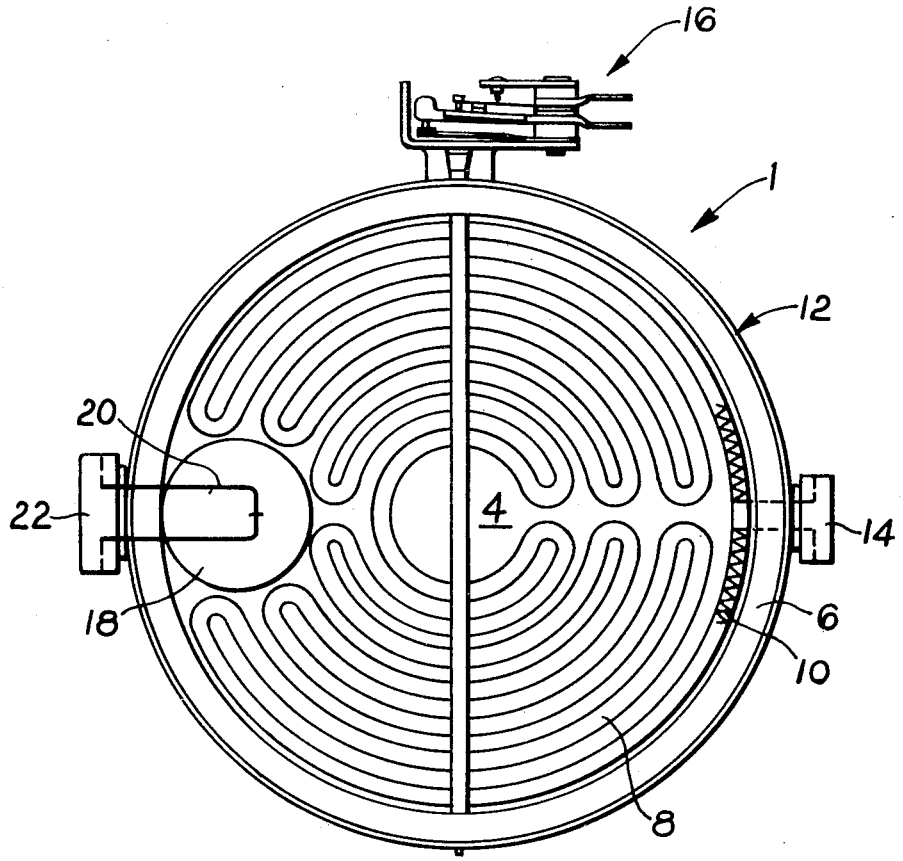
FIG. 1 shows one embodiment of a radiant heater according to the present invention.

Throughout the figures, the same reference numerals are used to denote the same or similar parts.

There is shown in FIG. 1 a radiant heater 1 comprising a metal dish containing a base layer 4 of electrical and thermal insulating material and a peripheral wall 6 of electrical and thermal insulating material. The base layer 4 is formed with a pattern of grooves 8 and a heating element 10 of bare helically coiled wire is secured in the grooves, for example by means of staples (not shown). The ends of the heating element are connected to a terminal block 14 and in order to prevent excessive temperatures a temperature limiter 16 is arranged over the heating element and is connected in series with the heating element 10. The temperature limiter 16 may comprise a snapswitch operated by a differential expansion assembly in the form of an inconel rod arranged within a quartz tube.

As illustrated in FIG. 1, in place of the conventional autocook sensor, which extends through a hole formed in the bottom of the heater, the hole is absent and there is provided a circular pad 18 of electrical and thermal insulating material, such as ceramic fibre, on which there is arranged a temperature sensor in the form of a thermocouple 20. The wires of the thermocouple extend outwardly over the peripheral wall 6, avoiding any contact with the metal dish 2 which terminates below the level of the top of the peripheral rim, and enter a terminal block 22. The thermocouple is maintained in good thermal contact with the underside of the glass ceramic cooking surface by means of the pad 18.

The position and size of the pad 18 are selected to isolate the temperature sensitive portion of the thermocouple as effectively as possible from the heat emitted by the radiant heater and to link the thermocouple thermally to the temperature of a cooking utensil (not shown). In this respect, the bases of most cooking utensils are domed to a greater or lesser extent, as will be explained in greater detail hereinafter, so that, while the outer region of a utensil may be in contact with the glass ceramic cooking surface, the central region of the utensil is generally not in contact with the cooking surface and it is therefore not possible accurately to determine the temperature of the utensil in the central region thereof. For this reason it is convenient to position the pad 18 at the periphery of the heater 1.

Whilst it is desirable, in order effectively to decouple the thermocouple 22 from the heat emitted by the heating element, to have as large a pad 18 as possible, a pad having too large an area is undesirable because this will produce a large cold area on the cooking surface which is detrimental to cooking performance. The optimum size of pad is thus dependent on the power rating of the heater element and on the diameter of the heated area; for an 1800 watt heating element arranged within a heated area of 195 mm diameter a pad of 40 to 50 mm diameter is preferable for most situations, although this may be varied in individual cases. For heaters having smaller areas, the size of the pad may be reduced accordingly. The position on the pad of the temperature sensitive portion of the thermocouple can also be important, but in most cases it is preferable to arrange this portion generally in the region of the centre of the pad.

The dimensions of the thermocouple wires may also be varied. It has been found that thicker wires promote faster cooling of the thermocouple, which enable the thermocouple to follow the temperature of the utensil more clearly once the utensil has been heated to the desired temperature. However, thicker wires take longer to heat up and so give a relatively slow response to the initial heating of the utensil. Thus, although it is possible to determine the temperature of the utensil to within 2° C. during steady state conditions, there will be a larger temperature difference, perhaps as much as 20° C., during the initial transient conditions. The thermocouple may be made of many materials, but copper/-constantan, and particularly chromel/alumel, have been found to be suitable. The thermocouple wires may have, for example, diameters of from 1 to 2 mm and in some cases it may be desirable particularly in the case of thicker wires to arrange the wires in a groove on the upper surface of the pad 18.

Figure 2:
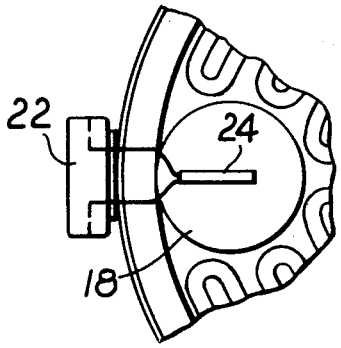
FIG. 2 shows a part of a second embodiment of a radiant heater according to the present invention.

In the embodiment shown in FIG. 2, the thermocouple has been replaced by a platinum resistance 24. The platinum resistance provides greater sensitivity, but is much more expensive than the thermocouple shown in FIG. 1.

Figure 3:
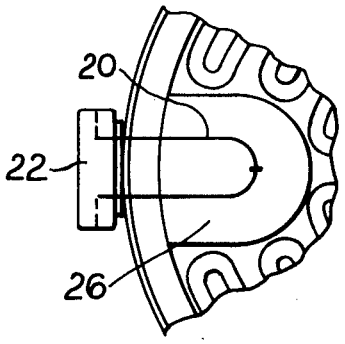
FIG. 3 shows a part of a third embodiment of a radiant heater according to the present invention.

In the embodiment shown in FIG. 3, the circular pad has been replaced by a pad 26 which is semicircular at the radially inner region of the heater, but conforms to the curvature of the peripheral rim of the heater where the peripheral rim and the pad are close to one another. The infilling of the gaps left by a circular pad more effectively decouples the sensor from the heater, or alternatively enables a smaller pad to be used. Although a thermocouple is illustrated in FIG. 3, this is merely by way of example and any suitable temperature sensor may be provided.

A measure of the effectiveness of the construction according to the present invention is the time taken to bring a predetermined volume of water to the boil compared with other forms of heater. By comparison, the heater according to the present invention takes no more than 50% longer than the time it would take the same heater using continuous full power. However, a standard autocook heater takes several times longer than the heater according to the present invention.

Figure 4:
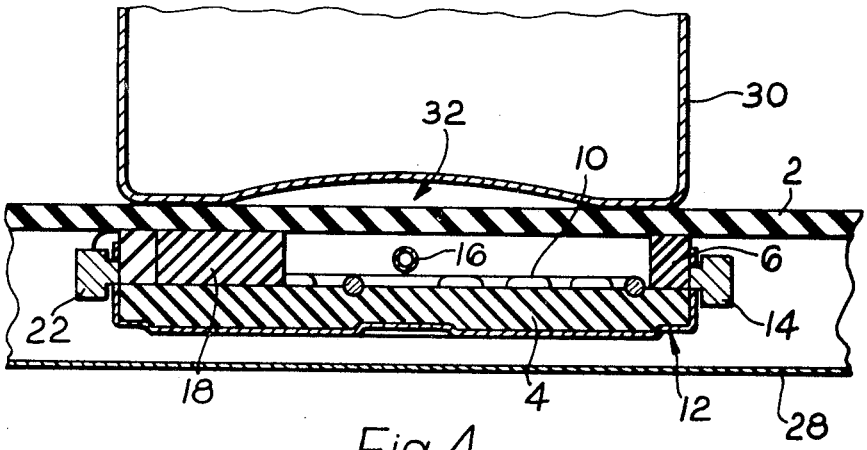
FIG. 4 is a diagrammatic cross-sectional view of a part of a glass ceramic top cooker according to the present invention with a utensil resting on the glass ceramic plate.

The glass ceramic top cooker shown in FIG. 4 comprises a radiant heater 1 arranged beneath a glass ceramic plate 2. The base of the heater is enclosed by a base plate 28, for example of sheet metal. The radiant heater 1 may be the heater shown in any one of FIGS. 1 to 3.

A utensil 30 rests on the upper surface of the glass ceramic plate and, as can be seen from FIG. 4, the bottom of the utensil is domed and so creates an air pocket 32 between the top of the glass ceramic plate and the bottom of the utensil. The size and configuration of the air pocket varies from utensil to utensil and therefore makes it difficult to determine the actual temperature of the utensil, and thus of the contents of the utensil, with any accuracy or consistency.

It is current practice for manufacturers of cooking pans and other utensils, to form their utensils with a slight inwardly extending dome in the base in order to enhance the stability of the utensil on the cooker. However, the dome results in the formation of the air pocket 32 between the upper surface of the glass ceramic plate and the bottom of the utensil, in which pocket the temperature of the entrapped air tends to rise significantly above the temperature of the base of the utensil. This air pocket can itself lead to a temperature sensor detecting unexpectedly high temperatures. Moreover, the problem is magnified by the fact that no two utensils are alike and thus it is not possible to provide a generalised solution to the problem because the temperature detected will vary from one utensil to the next and, indeed, will vary depending on the position of the utensil on the cooking surface.

Figure 5:
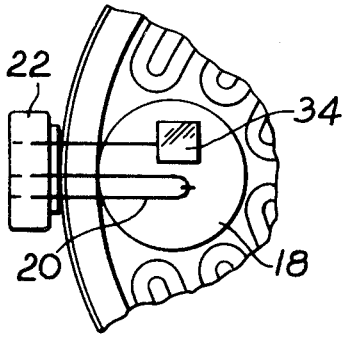
FIG. 5 shows a part of a radiant heater according to the present invention with a transducer positioned adjacent to a temperature sensor.

FIG. 5 shows how the radiant heater 1 may be adapted so as to overcome the problems caused by the air pocket 32. As can be seen from FIG. 5, in addition to the temperature sensor (i.e. thermocouple 20 or platinum resistance 24), there is arranged on the pad 18 a metallic plate 34. Both the temperature sensor and the metallic plate 34 are connected to a control device (not shown in FIG. 5) by way of a terminal block 22.

Figure 6:
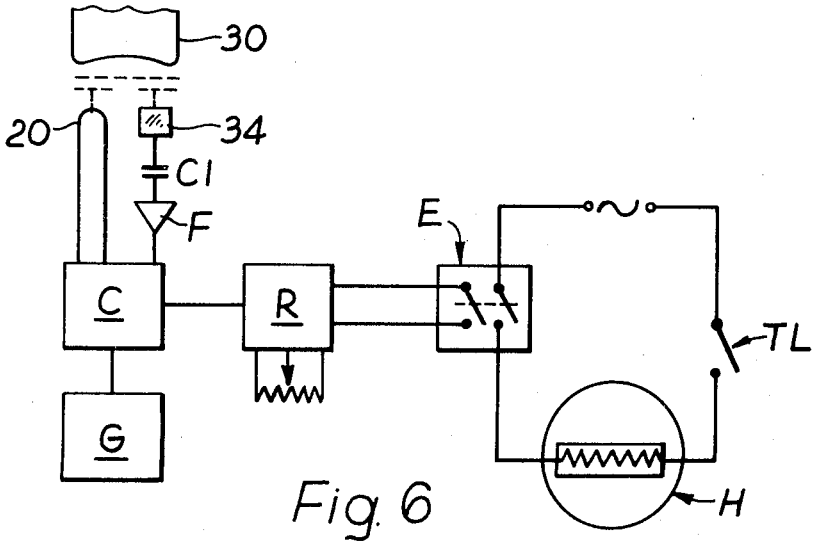
FIG. 6 is a schematic representation of an electrical circuit incorporating the transducer and the temperature sensor.

FIG. 6 shows schematically one embodiment of an electric circuit of a control device for the heater. A capacitative transducer is formed by a combination of utensil 30, thermocouple 20 (or platinum resistance 24) and the metallic plate 34. The utensil 30 forms with the thermocouple 20 a first capacitor and the plate 34 forms with the utensil a second capacitor in series with the first capacitor. Therefore, as the utensil is moved towards or away from the area of glass ceramic plate under which the transducer lies, the combined capacitance of the two capacitors formed between the thermocouple 20, the utensil 30 and the plate 34 will change. Thus, for a domed utensil, it is possible to determine the extent of the doming by electrical means and also to compensate for the effects of the doming by means of the control device.

The thermocouple 20 operates in a similar manner to a conventional autocook sensor. That is, the thermocouple 20 is intended to produce a signal, in this case an electrical signal, which is representative of the temperature of the utensil. The signal produced by the thermocouple 20 is processed by a controller C which controls an energy regulator R which itself controls an electric switch E such as a relay, transistor, thyristor or triac to supply electrical current to the heater H. TL represents the temperature limiter.

In addition, there is shown in FIG. 6 a constant frequency generator G which generates a signal of constant, relatively high frequency of, say, 1000 Hz. The signal is injected into the thermocouple 20 and is transmitted to the metallic plate 34 by way of the two capacitors formed by the utensil. The metallic plate 34 is also connected to the controller C by way of a capacitor C1 and a frequency-to-voltage converter F.

As is well known, the frequency detected by the frequency-to-voltage converter F will depend on the capacitance of the components through which the signal has passed—the higher the capacitance, the lower the frequency. However, since the only variable is the spacing of the bottom of the utensil from the thermocouple 20 and the metallic plate 34, the voltage produced by the frequency-to-voltage converter is representative of the spacing between the utensil and the plate 34.

The controller C uses the signal from the frequency-to-voltage converter F to modify the control of the regulator R which is based on the signal from the thermocouple 20 in order to compensate for the inaccuracies in the apparent temperature which is detected as a result of the doming of the utensil.

Figure 7:
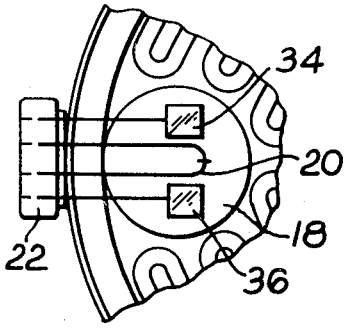
FIG. 7 shows part of a radiant heater in which a transducer is positioned on both sides of the temperature sensor.

FIG. 7 shows an alternative configuration for the components on the pad 18. As can be seen from FIG. 7, the thermocouple 20 (or platinum resistance) and the metallic plate 34 are provided as in the embodiment of FIGS. 5 and 6. However, in addition a further metallic plate 36 is arranged on the pad 18. The capacitative transducer in this case is therefore formed between the plate 34, the utensil 30 and the further plate 36, with the constant frequency generator G being connected to the further plate 36.

Clearly, the capacitative transducer may have many forms. For example, one plate of the capacitor need not be the thermocouple 20 or the further plate 36, but may be any other metallic component of the heater such as the dish 12 (see FIG. 7) or part of the temperature limiter 16. Moreover, the metallic plates 34 and 36 need not be arranged on the pad 18, but may be fixed to the underside of the glass ceramic plate at any convenient position.

Further, the transducer need not be capacitative, but may operate on any principle which gives a response which is dependent on the position or shape of the utensil. For example, the transducer may be inductive or magnetoresistive.

While the invention has been described in detail above, it is to be understood that this detailed description is by way of example only, and the protection granted is to be limited only within the spirit of the invention and the scope of the following claims.

I claim:

1. A glass ceramic top cooker comprising:

a glass ceramic plate forming a cooking surface; and at least one radiant electric heater arranged immediately beneath the plate and comprising a continuous base layer of electrical and thermal insulating material, a peripheral wall of electrical and thermal insulating material, a heating element arranged on the base layer, thermal insulating means disposed on the base layer within a region adjacent and bounded by the peripheral wall for thermally isolating a region within the peripheral wall from heat emitted by the heating element, and a temperature sensor mounted on said thermal insulating means within the isolated region so as to be in thermal contact with the underside of the plate whereby, in use, the temperature sensor is sensitive only to the temperature of said plate which is determined by the temperature of a cooking pan which is positioned on the plate and is heated by the heater.

2. A glass ceramic top cooker according to claim 1, wherein the isolating means comprises a pad of insulating material.

3. A glass ceramic top cooker according to claim 2, wherein the pad is located adjacent to the peripheral wall.

4. A glass ceramic top cooker according to claim 2, wherein the pad is circular.

5. A glass ceramic top cooker according to claim 4, wherein the pad has a diameter of 40 to 50 mm.

6. A glass ceramic top cooker according to claim 3, wherein the pad is part-circular at a radially inner region of the heater and conforms to the curvature of the peripheral wall of the heater where the peripheral wall and the pad are close to one another.

7. A glass ceramic top cooker according to claim 2, wherein the pad is made of ceramic fibre.

8. A glass ceramic top cooker according to claim 2, wherein the pad has an area of approximately 4 percent to 8 percent of the area within the peripheral wall of the heater.

9. A glass ceramic top cooker according to claim 1, wherein the temperature sensor is a thermocouple.

10. A glass ceramic top cooker according to claim 9, wherein the thermocouple is made of materials selected from the group consisting of chromel/alumel and copper/constantan.

11. A glass ceramic top cooker according to claim 9, wherein the thermocouple wires have a diameter of 1 mm to 2 mm.

12. A glass ceramic top cooker according to claim 1, wherein the temperature sensor is a platinum resistance.

13. A glass ceramic top cooker according to claim 1, wherein the temperature sensor is mounted substantially centrally of the isolated region.

14. A glass ceramic top cooker according to claim 1, wherein the temperature sensor is mounted in the isolated region so as to be offset from the centre thereof towards the centre of the heater.

15. A glass ceramic top cooker comprising:

a glass ceramic plate forming a cooking surface; and at least one radiant heater arranged immediately beneath the plate and comprising:

(a) a continuous base layer of electrical and thermal insulating material, (b) a peripheral wall of electrical and thermal insulating material, (c) a heating element arranged on the base layer, (d) means disposed on the base layer for isolating a region within the peripheral wall from heat emitted by the heating element, (e) a temperature sensor mounted within the isolated region so as to be adjacent to the underside of the plate whereby, in use, the temperature sensor is sensitive substantially only to the temperature of a cooking pan which is positioned on the plate and is heated by the heater, (f) means for determining the location of a base of the cooking pan relative to the glass ceramic plate, and (g) means for controlling the supply of electric current to the heating element of the radiant heater in response to an apparent temperature of the base of the cooking pan detected by the temperature sensor and in response to the location of the base of the cooking pan.

16. A cooker according to claim 15, wherein the location determining means comprises a transducer positioned in the isolated region adjacent to the temperature sensor.

17. A cooker according to claim 16, wherein the transducer is a capacitative transducer.

* * * * *